US006065565A

United States Patent [19]

Puszkiewicz et al.

[11] Patent Number: 6,065,565

[45] Date of Patent: May 23, 2000

[54] HYBRID POWER SYSTEM FOR A VEHICLE

[75] Inventors: Ignacy Puszkiewicz, Hagerstown, Md.; Richard G. Taylor, McConnellsburg, Pa.

[73] Assignee: JLG Industries, Inc., McConnellsburg, Pa.

[21] Appl. No.: 08/791,676

[22] Filed: Jan. 30, 1997

[51] Int. Cl.[7] ..... B66F 11/04

[52] U.S. Cl. ..... 182/2.9; 182/69.1; 182/148

[58] Field of Search ..... 182/2.1–2.11, 63.1, 182/69.1–69.6, 148

[56] References Cited

U.S. PATENT DOCUMENTS

| | | | |
|---|---|---|---|
| 2,667,761 | 2/1954 | Sellstrom . | |
| 3,941,012 | 3/1976 | Mayer . | |
| 4,037,684 | 7/1977 | Moyer . | |
| 4,188,569 | 2/1980 | Campbell . | |
| 4,339,015 | 7/1982 | Fowkes et al. . | |
| 4,461,958 | 7/1984 | Krohling et al. . | |
| 5,166,587 | 11/1992 | Smart . | |
| 5,193,635 | 3/1993 | Mizuno et al. . | |
| 5,212,431 | 5/1993 | Origuchi et al. . | |
| 5,318,142 | 6/1994 | Bates et al. . | |
| 5,343,970 | 9/1994 | Severinsky | 180/65.2 |
| 5,418,437 | 5/1995 | Couture et al. . | |
| 5,441,122 | 8/1995 | Yoshida . | |
| 5,566,774 | 10/1996 | Yoshida . | |

OTHER PUBLICATIONS

Genie Z., Z–45/22, Bi fuel, Genie Industries, 1993.

"Generating Interest in Hybrid EVs," *Motor Trend,* p. 22, Feb. 1996.

"Power Electronics for Environmental Car," *Gemini Magazine,* Dec. 1993.

"Does the Future Belong to Hybrids?," *Motor Trend,* p. 26, Apr. 1996.

"Inside the Dodge Hybrid–Drive Intrepid: Sport Sedan of the 21st Century," *Motor Trend,* pp. 30–35, Apr. 1996.

"Concept Truck Addresses Future Clean Air Demands with Hybrid Turbine–Electric Powertrain," *Diesel Progress Engine & Drives,* pp. 54–56, Feb. 1996.

"Batteries Not Included," *Business Week,* pp. 78–80, Sep. 23, 1996.

Three (3) Niftylift Brochures featuring Model Nos. SP.26BE, SP.33BE and SP.33NBE, Niftylift, Inc., 1025 Kensington Way, Annapolis, Maryland 21403 (date unknown).

One (1) Genie 1 Brochure featuring Model Z–45/22 Tri–Fuel Articulated Boom, Genie Industries, 18340 NE 76th Street, Redmond, Washington 98073–0069 (date unknown).

"Hybrid Vehicle Propulsion Program," United States Department of Energy, Dec. 18, 1996.

*Primary Examiner*—Alvin Chin-Shue

*Attorney, Agent, or Firm*—Reed Smith Shaw & McClay LLP

[57] ABSTRACT

An apparatus includes a generator assembly having a power source operable to power a generator. The generator is connected to a battery assembly having one or more batteries. The battery assembly is operably connected to a drive system, such as an electric drive propulsion assembly and/or an electric or hydraulic positioning assembly. A selector is operably connected to the generator assembly to select either the battery assembly or both of the generator assembly and the battery assembly to power the apparatus.

17 Claims, 13 Drawing Sheets

| A | B | OUTPUT |
|---|---|---|
| 0 | 0 | OFF |
| 0 | 1 | BATTERIES ONLY |
| 1 | 0 | CHARGE |
| 1 | 1 | HYBRID |

HYBRID POWER SYSTEM FOR A VEHICLE

BACKGROUND OF THE INVENTION

The present invention relates generally to vehicles having multiple power sources and, more particularly, to a hybrid power system for mobile access vehicles and equipment.

Several manufacturers offer mobile access vehicles and equipment, including self-propelled and trailer-mounted boom, vertical and scissors lifts, that allow construction, maintenance and like personnel to be lifted to and suspended at high or otherwise hard-to-reach places on a job site. The advent of these access vehicles and equipment has greatly reduced the need and desire for conventional scaffolding on construction and other sites.

The great majority of mobile access vehicles manufactured and sold today are either engine-powered/hydraulically-driven, battery-powered/hydraulically-driven or battery-powered/electrically-driven. However, a small number (i.e., approximately 5% or less) of mobile access vehicles are equipped with both engines and battery packs (i.e., multi-powered) for either engine-powered or battery-powered operation, but not both at the same time.

Because the above-mentioned multi-powered access vehicles are hydraulically-driven, their efficiency is less than optimum due to power losses caused by multiple power transformations between the battery and the hydraulic drive motor(s). For example, in a conventional, battery-powered/hydraulically-driven access vehicle, the electric energy stored in the battery pack is used to power an electric motor, the electric energy is transformed into mechanical energy to power an hydraulic pump, the hydraulic pump transforms the mechanical energy into hydraulic energy to power an hydraulic drive motor, then the hydraulic energy is transformed into mechanical energy to power the wheels or other propulsion device of the vehicle.

As a result of the power transformation losses, and because the engine and the battery pack cannot be operated together to power a conventional access vehicle, the charge of the battery pack is often quickly depleted, possibly, depending on the workload, before a work shift has ended. To recharge the battery pack, the vehicle may have to be idled and connected to an external AC power source at an inconvenient time, which results in unwanted downtime and increased cost to the operator.

For an access vehicle having an on-board battery charger, the battery charger may be plugged into an external AC power source by means of an extension cord to recharge the battery pack. Even though the presence of an on-board battery charger may allow the vehicle to be operated with a depleted or low battery pack, it may be inconvenient or not recommended by the manufacturer to use the mobile vehicle while it is connected to an extension cord. As can be appreciated, a self-contained access vehicle would have a distinct advantage over one which must be plugged into an external power source to recharge its battery pack.

Furthermore, due to the power transformation losses and the anticipated peak power requirements of the vehicle, and because the battery pack and the engine cannot be operated at the same time to power the vehicle, the engine of a conventional access vehicle is sized to meet the maximum or peak power requirements of the hydraulic drive system, which occurs relatively infrequently during vehicle operation. Consequently, the engine is oversized for all other non-peak performance operations. Because fuel consumption, noise and exhaust emissions are proportionally related to engine size, it is readily apparent that an access vehicle having an engine sized for average power requirements, not the occasional peak power requirement, would be beneficial to vehicle operators and the environment.

Typically, manufacturers have sold mobile access vehicles and equipment to rental fleet operators and larger construction companies. To maximize the return on their investment, access vehicle and equipment owners must have the correct vehicle or equipment for the particular job.

Current (and anticipated) environmental laws makes it exceedingly difficult to operate engine-powered vehicles and equipment indoors. Consequently, for example, as a building construction project progresses from site preparation to an enclosed structure, engine-powered vehicles and equipment must be exchanged for or switched over to battery-powered ones.

Further, due to the increasing pace of construction projects, AC power is being installed later in the construction process than previously. If engine-powered generators are not readily available or may not be used, the lack of AC power makes it impossible to charge the battery-powered vehicles generally required for indoor use during a substantial portion of the project, resulting in the operator needing an increased number of access vehicles to complete the job.

Several automobile companies have attempted to address some of the concerns addressed above regarding battery longevity and recharging. For example, a number of automobiles which utilize a combination of battery and engine power for propulsion have been developed, such as Chrysler's Dodge Intrepid ESX and Volvo's ECC. In these automobiles, the engine is used to supplement the power output of the battery to thereby extend the driving range of the automobile, which is otherwise severely limited by the batteries. However, because automobiles are intended for only outdoor use, the "indoor" use issues discussed above regarding mobile access vehicles and equipment have not been adequately addressed by the automobile industry.

Consequently, it is apparent that rental fleet operators and access vehicle and equipment operators and owners would desire a mobile access vehicle that can operate either on battery power alone, when indoor use is required, or on a combination of engine and battery power when power demands require engine power to assist the battery or when the battery needs to be recharged.

SUMMARY OF THE INVENTION

The present invention provides an apparatus that can be operated either on battery power alone (i.e., battery mode) or on a combination of battery and engine power (i.e., hybrid mode). Depending on need (i.e., battery assist or recharge) or operation constraints (i.e., "indoor" versus "outdoor" use), the apparatus may be switched, on demand, between battery mode and hybrid mode.

The present invention also combines electric drive technology (i.e., electric drive motors) with an engine-powered generator, thereby eliminating the need for and inefficiency of hydraulic pumps and motors. When the apparatus is operated in battery mode, battery power is used to directly drive the electric motors. In hybrid mode, the apparatus continues to draw power from the batteries, which supply the peak power requirements of the apparatus, but the engine-powered generator is able to replenish battery power at the average rate that it is being used. Consequently, regardless of whether the apparatus is operated in battery mode or hybrid mode, there is substantially no difference in apparatus function or performance.

In addition, because the engine-powered generator supplements battery power, the present invention provides an apparatus having an engine sized for average power demand, not peak power demand. Thus, the engine may be significantly smaller than those required for conventional mobile access vehicles, which provides a corresponding reduction in noise, exhaust emissions and fuel consumption.

Moreover, by incorporating an engine-driven generator in the power system, and by allowing the generator to operate as a battery charger when required, the present invention provides an apparatus whose batteries may be recharged at any time or place where the engine may be operated.

According to a first aspect of the present invention, an apparatus includes a generator assembly having a power source, such as an engine, operable to power a generator. The generator is operably connected to a battery assembly having one or more batteries. The battery assembly is operably connected to a drive system, such as an electric drive propulsion assembly. A selector is operably connected to the generator assembly to select either the battery assembly or both of the generator assembly and the battery assembly to power the apparatus.

According to a second aspect of the present invention, a power system for an apparatus includes a generator assembly having a power source, such as an engine, operable to power a generator. The generator is operably connected to a battery assembly having one or more batteries. A selector is operably connected to the generator assembly to select either the battery assembly or both of the generator assembly and the battery assembly to power the apparatus.

According to a third aspect of the present invention, a mobile access vehicle includes a base, a propulsion device connected to the base, a lift device operably connected to the base, and a power system supported on the vehicle. The power system includes a generator assembly having a power source, such as an engine, operable to power a generator, a battery assembly having one or more batteries, and a selector operably associated with the generator assembly. The selector functions to select either the battery assembly or both of the generator assembly and the least one battery assembly to power the vehicle. The vehicle further includes one or both of a propulsion assembly operably connected to the power system and the propulsion device, and an independent positioning assembly operably connected to the power system and the lift device. The propulsion assembly drives the propulsion device to propel the vehicle and the positioning assembly powers the lift device.

The present invention provides an apparatus, which may include a vehicle and mobile or stationary equipment, that can be operated either on battery power alone or on a combination of battery and engine power, depending on need. The performance capabilities of the apparatus, regardless of whether it is powered by battery power alone or on a combination of battery power and engine power, are substantially equal.

Furthermore, the present invention provides a versatile apparatus that can be operated indoors on battery power alone or outdoors on a combination of battery and engine power. Because the apparatus of the present invention may be operated in practically any construction or maintenance environment, rental fleet operators, construction companies and the like will be able to make do with a smaller inventory of vehicles and equipment.

The present invention, together with other aspects and attendant advantages thereof, will best be understood upon consideration of the following detailed description taken in conjunction with the appended drawings.

DETAILED DESCRIPTION OF THE PRESENTLY PREFERRED EMBODIMENTS

The present invention is described below in terms of mobile access vehicles, primarily boom lifts 10, vertical lifts 13 and scissors lifts 11. However, it should be understood that the present invention is applicable to any suitable battery-powered apparatuses that can also be powered by an engine or other power source, including but not limited to stationary or mobile vehicles or equipment, such as automobiles, fork lifts, fork trucks and factory delivery vehicles.

Figure 1A:
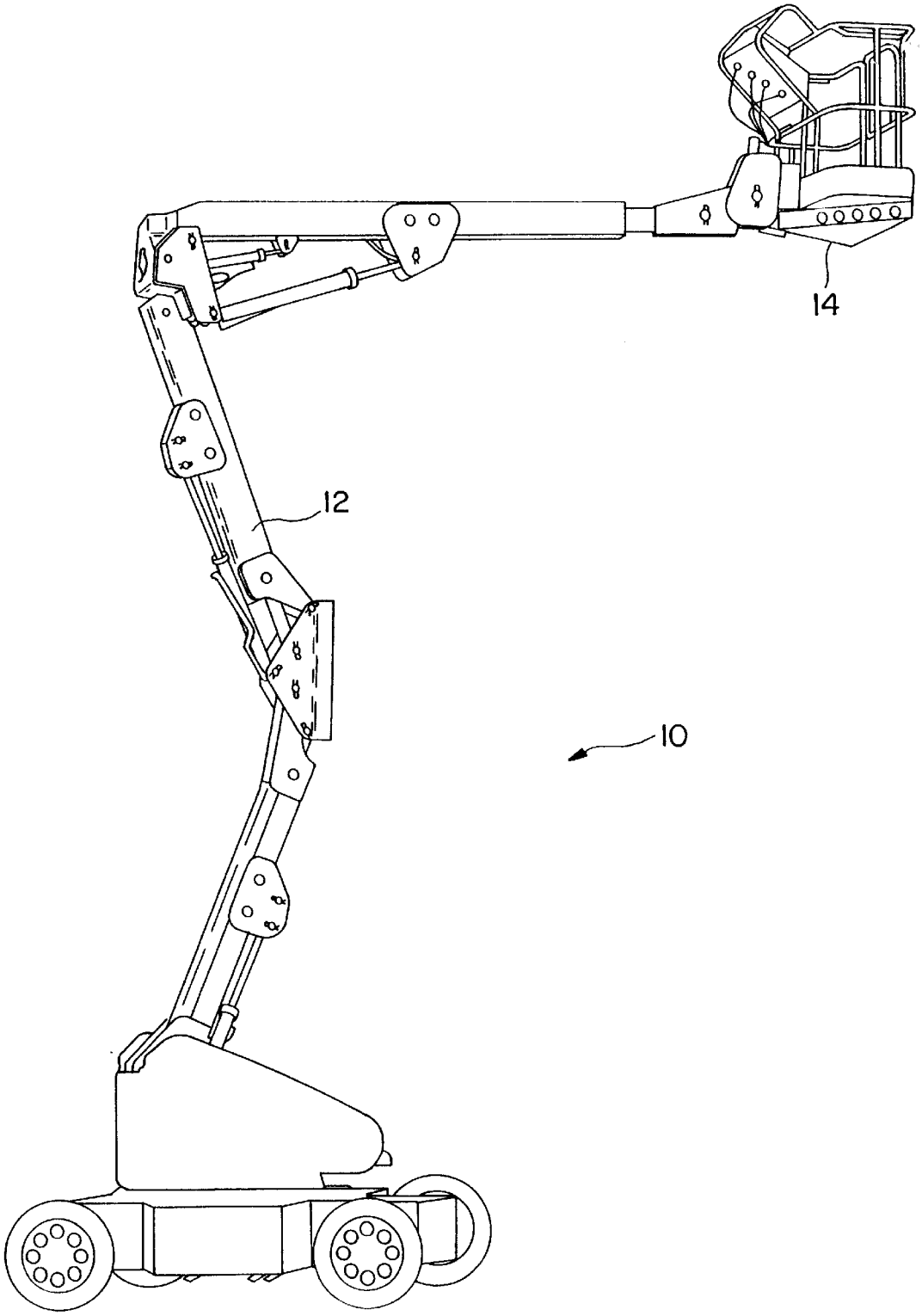
FIGS. 1*a*–1*c* are elevational views of mobile access vehicles.
Figure 1B:
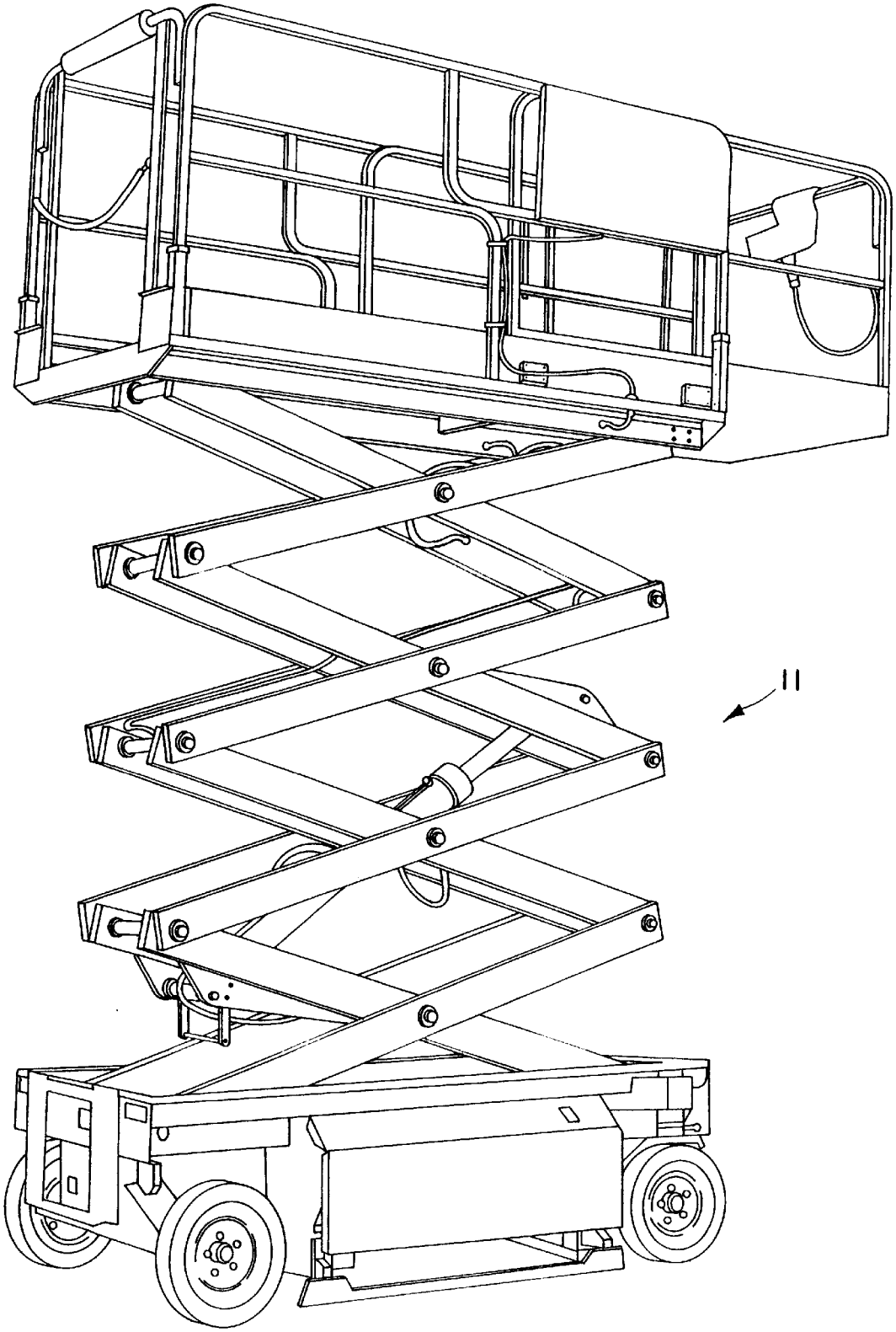
Figure 1C:
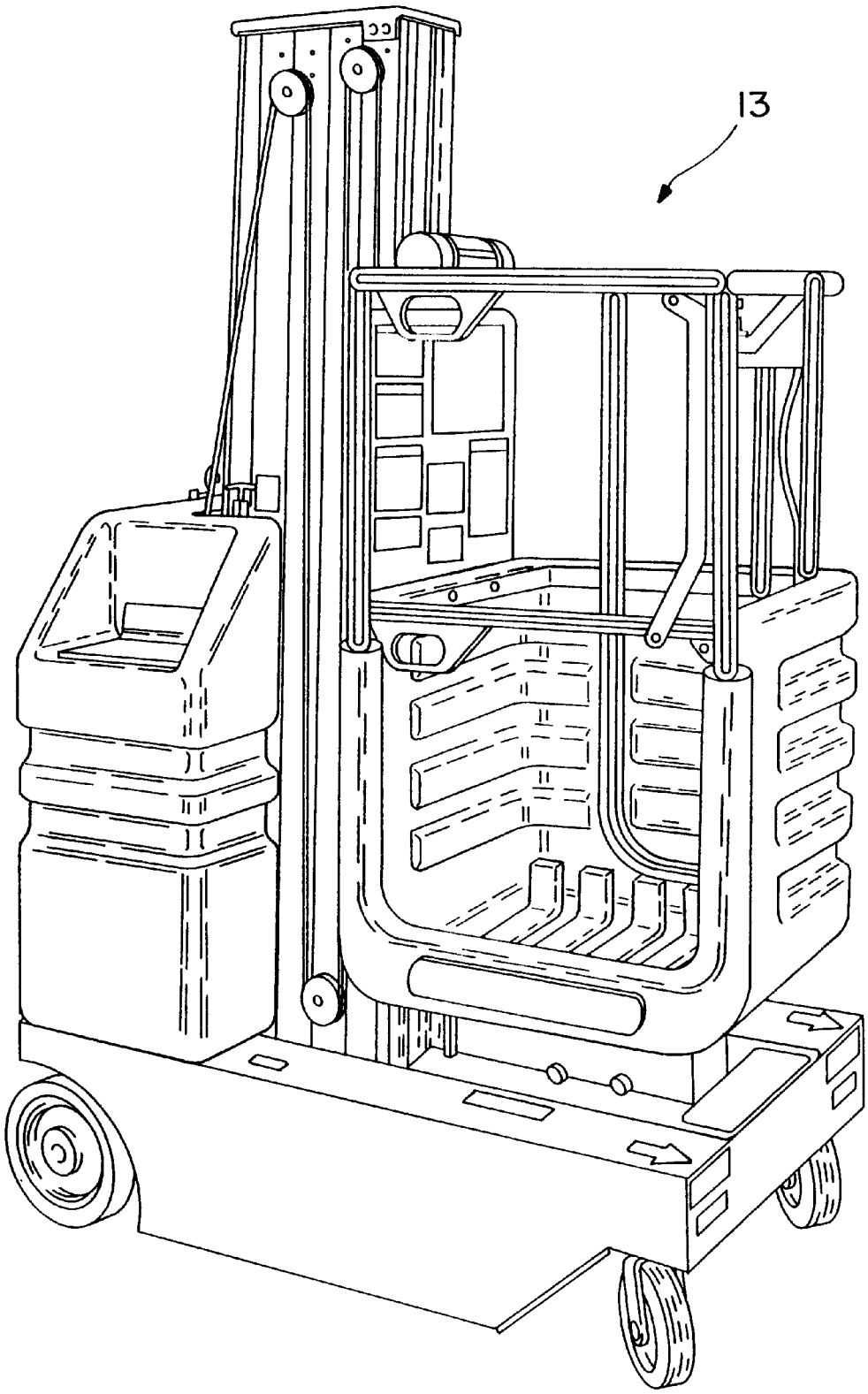

Turning now to the drawings, FIGS. 1*a*–1*c* depict a mobile articulating boom lift 10, a mobile scissors lift 11, and a mobile vertical lift 13, respectively.

As shown in FIG. 1*a*, the mobile articulating boom lift 10 is used for lifting and suspending persons at high or otherwise hard-to-reach places on a job site. As shown, the mobile articulating boom lift 10 is wheel-driven and includes an hydraulically-powered articulating boom 12 having a platform 14 secured to the free end thereof.

Figure 2:
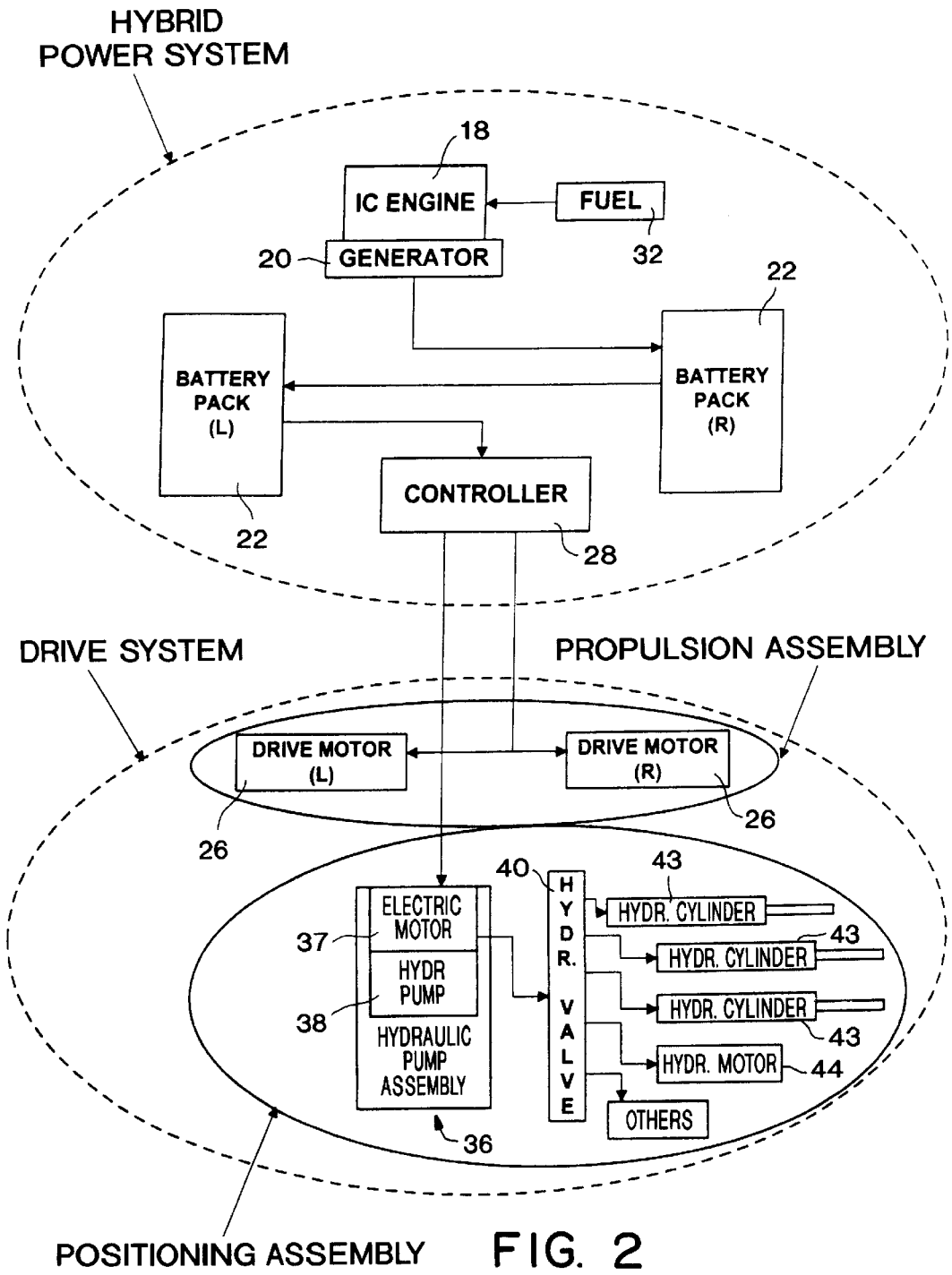
FIG. 2 is a block schematic diagram of the power and drive system components of a preferred embodiment of the apparatus of the present invention.

As shown in FIG. 2, the lift or other apparatus includes a number of power and drive system components mounted thereon. Specifically, the power system of the apparatus includes an internal combustion (IC) engine 18 that powers a 48 Volt DC generator 20. The generator 20 is operably connected to two 24 Volt battery packs 22, which preferably include four 6 Volt batteries. However, any suitable voltage or number of batteries, including one 48 Volt battery pack, may be used. Further, the battery pack 22 is operably connected to one or more drive systems via a motor controller 28, which provides speed control for the drive systems. In addition, a fuel tank 32 for the engine 18 is mounted on the apparatus.

In a preferred embodiment, the power system is operably connected to two drive systems: a propulsion assembly for propelling the apparatus; and a positioning assembly for steering the apparatus and for powering and controlling lift and/or other work functions of the apparatus.

As shown in FIG. 2, the propulsion assembly preferably includes two electric drive motors 26, each of which is connected to a wheel or other suitable propulsion device, such as a track, for propelling the apparatus. Depending on need or suitability, one drive motor 26 may be used to drive two wheels via a gearbox or differential-type axle or four drive motors 26 may be provided for "four-wheel" drive.

Further, as shown in FIG. 2, the positioning assembly preferably includes an hydraulic pump assembly 36 having an electric motor 37 operably connected to an hydraulic pump 38. The hydraulic pump assembly 36 is operably connected to an hydraulic valve 40 to power one or more hydraulic cylinders 43, hydraulic motors 44 and/or other hydraulic devices to power various steering, lift and other work functions of the apparatus.

In an alternate embodiment, the positioning assembly may include an electric positioning assembly (not shown) for powering and controlling the steering, lift and other work functions of the apparatus. Specifically, the electric positioning assembly may include one or more electric motors. In addition, the one or more electric motors may be operably connected to one or more actuators, such as linear or rotary actuators, to obtain the motion necessary to power and control the various work functions of the apparatus.

Figure 3:
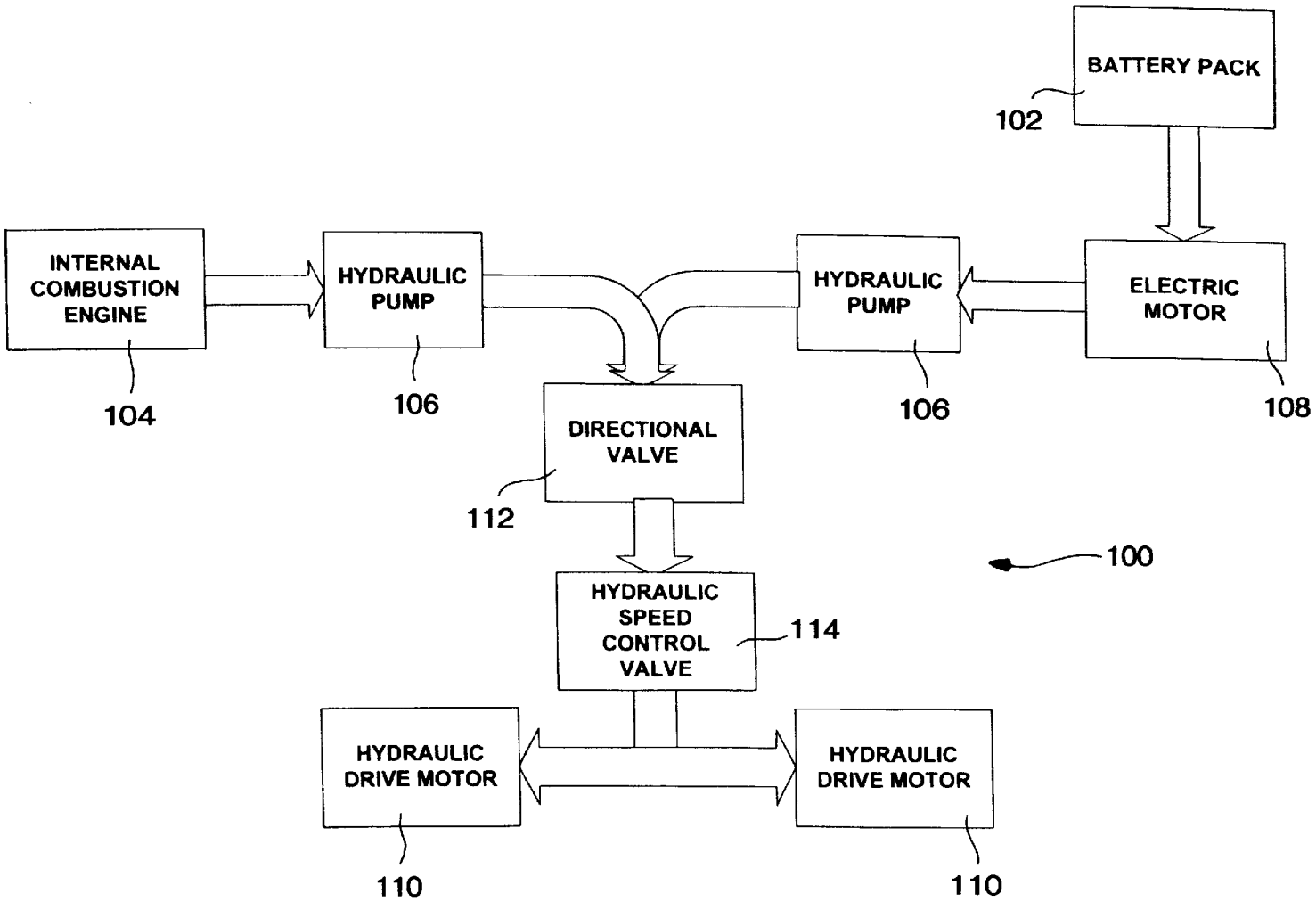
FIG. 3 is a block schematic diagram of a conventional dual power system for a mobile access vehicle.

A conventional dual power source system 100 for a mobile access vehicle is shown in FIG. 3. As shown therein, the vehicle (not shown) may be powered by either a battery pack 102 or an IC engine 104, but not by both at the same time.

When operated in battery mode, the battery pack 102 of the access vehicle powers an hydraulic pump 106 by means of an electric motor 108. The hydraulic pump 106 drives the hydraulic drive motors 110 by means of a directional control valve 112 and an hydraulic speed control valve 114. The hydraulic drive motors 110, in turn, drive the wheels (not shown) or other propulsion device of the access vehicle.

When operated in engine mode, the engine 104 of the access vehicle powers the hydraulic pump 106 and, ultimately, the remaining components shown in FIG. 3. Because the engine 104 is not operably connected to the battery pack 102 in any way, the engine 104 may not be used to supplement the power of or recharge the battery pack 102.

Figure 4:
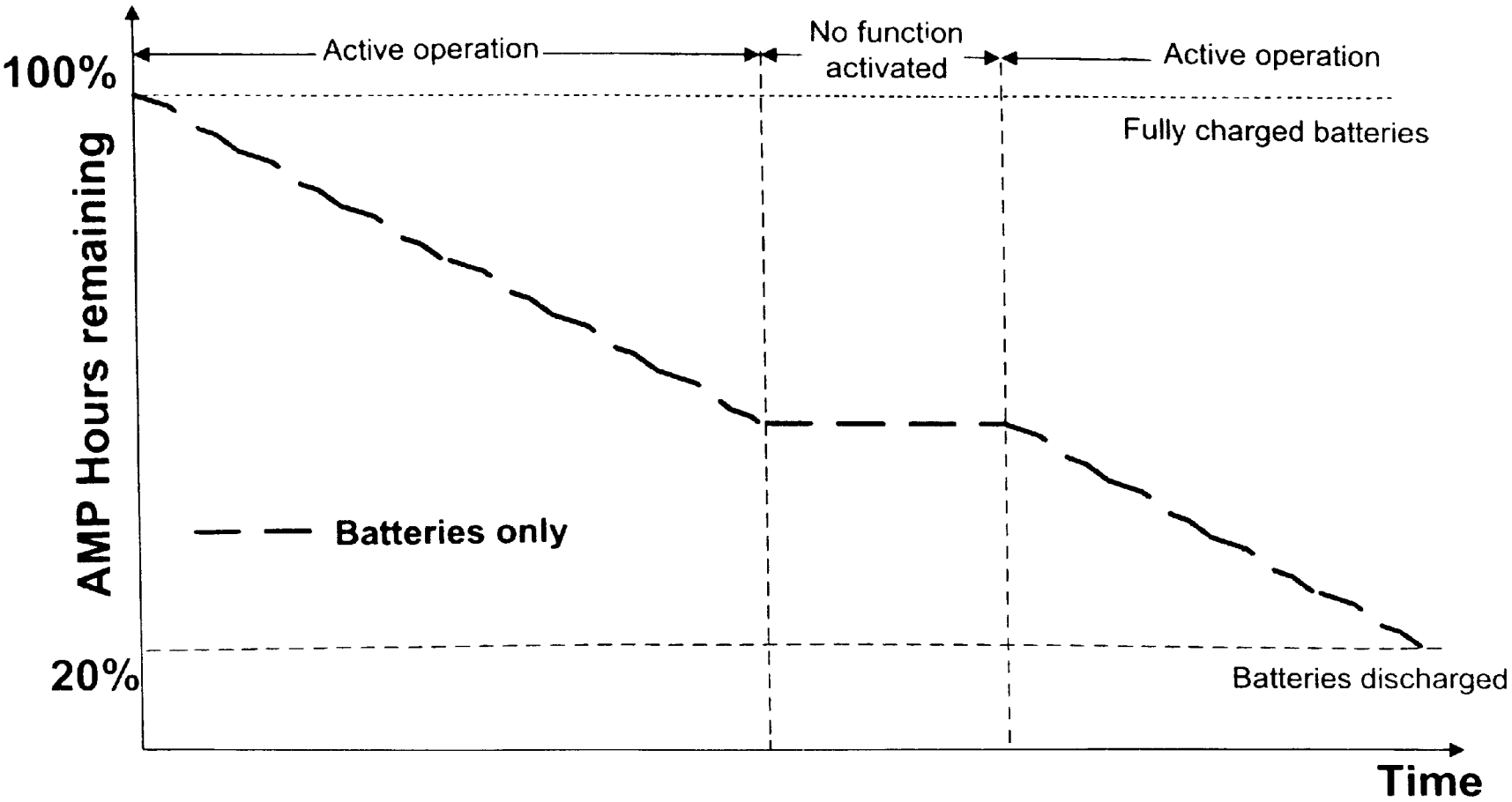
FIG. 4 is a graphical diagram of the battery duty cycle of the conventional dual power system shown in FIG. 3.

As depicted graphically in FIG. 4, when the vehicle is operated in battery mode, the power of the battery pack 102 is depleted at a variable rate, depending on how the access vehicle is being operated. When the access vehicle is not being operated, such as during breaks or at the end of the day, the battery pack 102 remains at its then current charge. When the access vehicle is again operated, the power of the battery pack 102 continues to be depleted until it is eventually discharged, at which time the vehicle is no longer operable and must be recharged by an external AC power source.

Figure 5A:
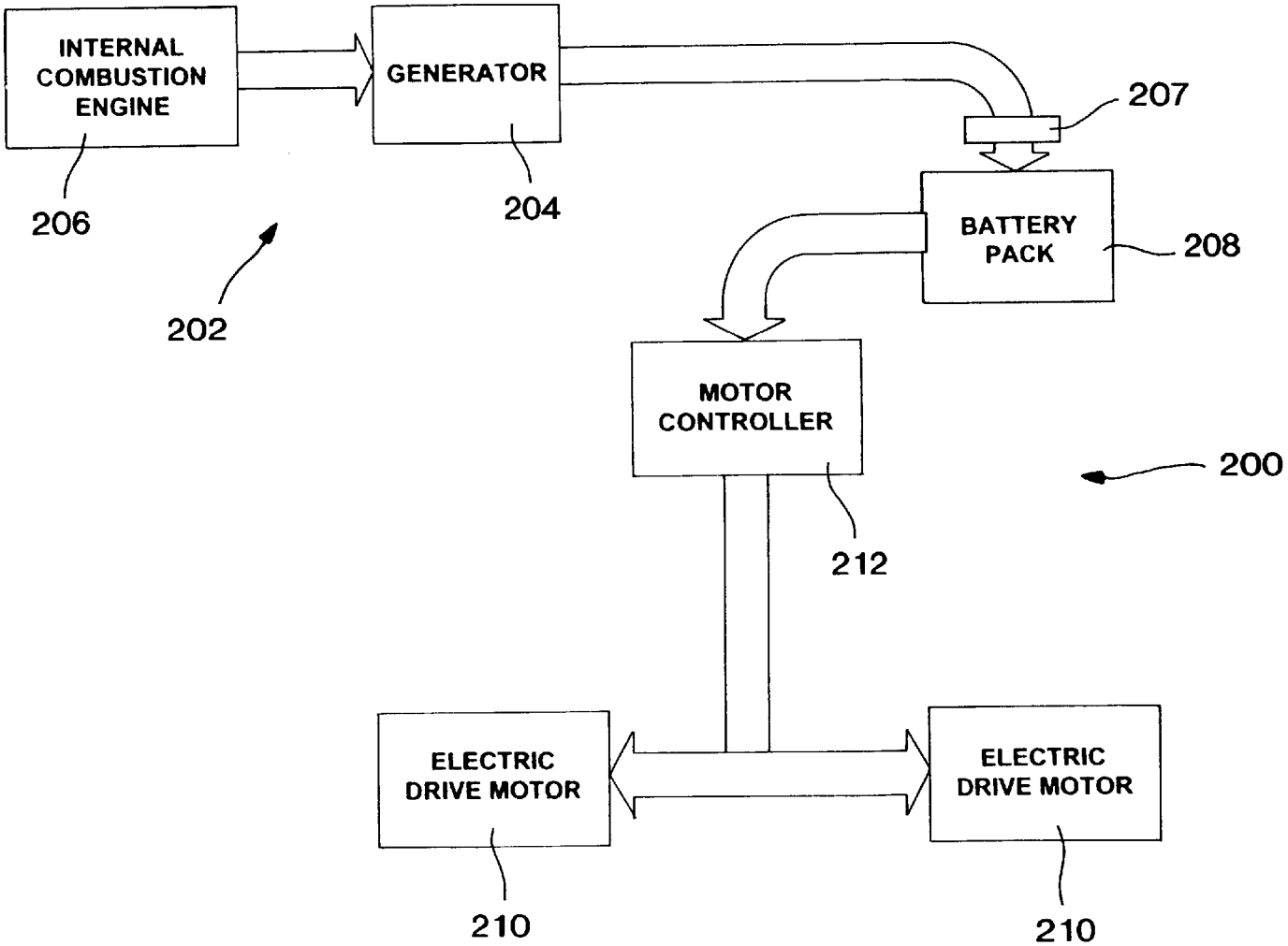
FIG. 5*a* is a block schematic diagram of the preferred embodiment of the hybrid power system of the present invention.

The preferred embodiment of the hybrid power system 200 for an apparatus, such as mobile access vehicles and stationary or mobile equipment, is shown in FIG. 5*a*. As shown therein, a generator assembly 202, including a generator 204 powered by an IC engine 206, is operably connected to a battery pack or assembly 208 of matching voltage, which may include any suitable number of batteries. In addition, instead of a generator 204 powered by an IC engine 206, the generator assembly 202 may comprise a fuel cell (not shown).

Alternately, the generator 204 may comprise an alternator (not shown) operably connected to an on-board battery charger (not shown). In this embodiment, the IC engine 206 may be operably connected to the battery charger via the alternator. The battery charger, in turn, may be operably connected to the battery pack 208. Therefore, it should be understood that the term "generator," as used herein, includes, but is not limited to, a conventional generator as well as an alternator operably connected to a battery charger.

Instead of an IC engine 206, any suitable type of power source, such as a gas turbine engine, may be used to power the generator 204. Further, any suitable type of battery, including lead-acid or nickel-cadmium batteries, may be used in the present invention.

The battery pack 208 powers the electric drive motors 210 by means of a DC motor controller 212, which regulates the speed of the drive motors 210 and the positioning assembly (not shown). Each of the drive motors 210 is operably connected to a wheel (not shown) or other propulsion device of the apparatus, such as a track.

Because the generator assembly 202 is directly connected to the battery pack 208, the apparatus may be operated on either battery power alone (i.e., battery mode) or an a combination of battery and engine power (i.e., hybrid mode). However, the battery pack 208 is sized to supply all the power requirements of the drive motors 210, which are variable depending on such conditions as function, terrain and speed.

Figure 5B:
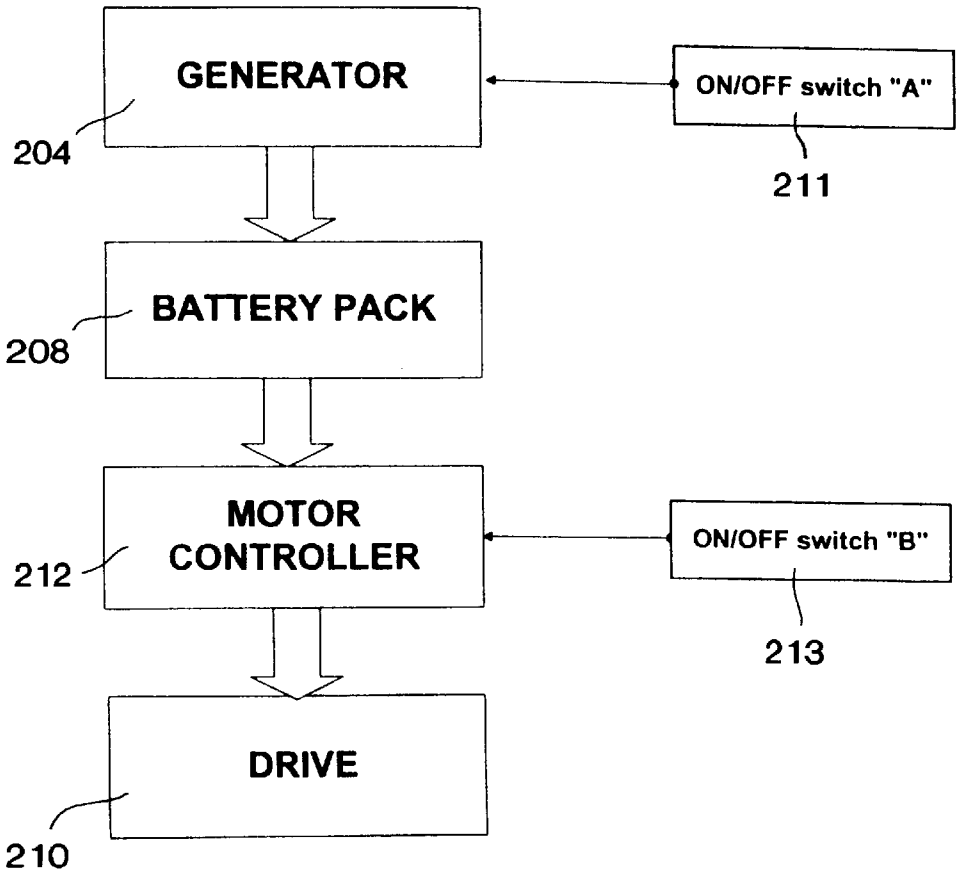
FIG. 5*b* is an expanded block schematic diagram, including a logic chart, of the preferred embodiment of the hybrid power system of the present invention.

As shown in FIG. 5*b*, the output of the apparatus is preferably controlled by manually-controlled or automatic on/off switches 211, 213. As depicted, the switch 211 is operably connected to the generator 204 and the battery pack 208 to control whether power is delivered by the generator 204 to the battery pack 208. The switch 213 is operably connected to the motor controller 212 to control whether power is delivered to the drive system to propel, steer or operate lift or other features of the apparatus. Therefore, as can be appreciated, when the switch 213 is in the "off" position, the apparatus is inactive or will not move or perform work.

A logic chart is provided in FIG. 5*b* to illustrate the various operational states of the apparatus. (In the chart, a "0" means the switch is "off" and a "1" means the switch is "on.") As shown, when both switches 211, 213 are "off," the apparatus is turned off or otherwise inactive. When the switch 211 is "off" and the switch 213 is "on," the apparatus is operating in battery mode. When the switch 211 is "on" and the switch 213 is "off," the generator assembly 202 is activated and the generator 204 is charging the battery pack 208, but the apparatus is not moving or performing work. Finally, when both switches 211, 213 are "on," the apparatus is operating in hybrid mode.

When the apparatus is operated in battery mode (e.g., for indoor use), the battery pack 208 powers the apparatus until the batteries are depleted, at which time they must be recharged by the generator assembly 202 or an external AC power source.

When the apparatus is operated in hybrid mode (e.g., for outdoor use), the condition of charge of the battery is continuously measured by a sensor circuit 207. The generator 204 responds to decreasing condition of charge by supplying power to the battery pack 208 sufficient to provide the average use requirements, rather than the peak power requirements, of the apparatus.

Figure 6:
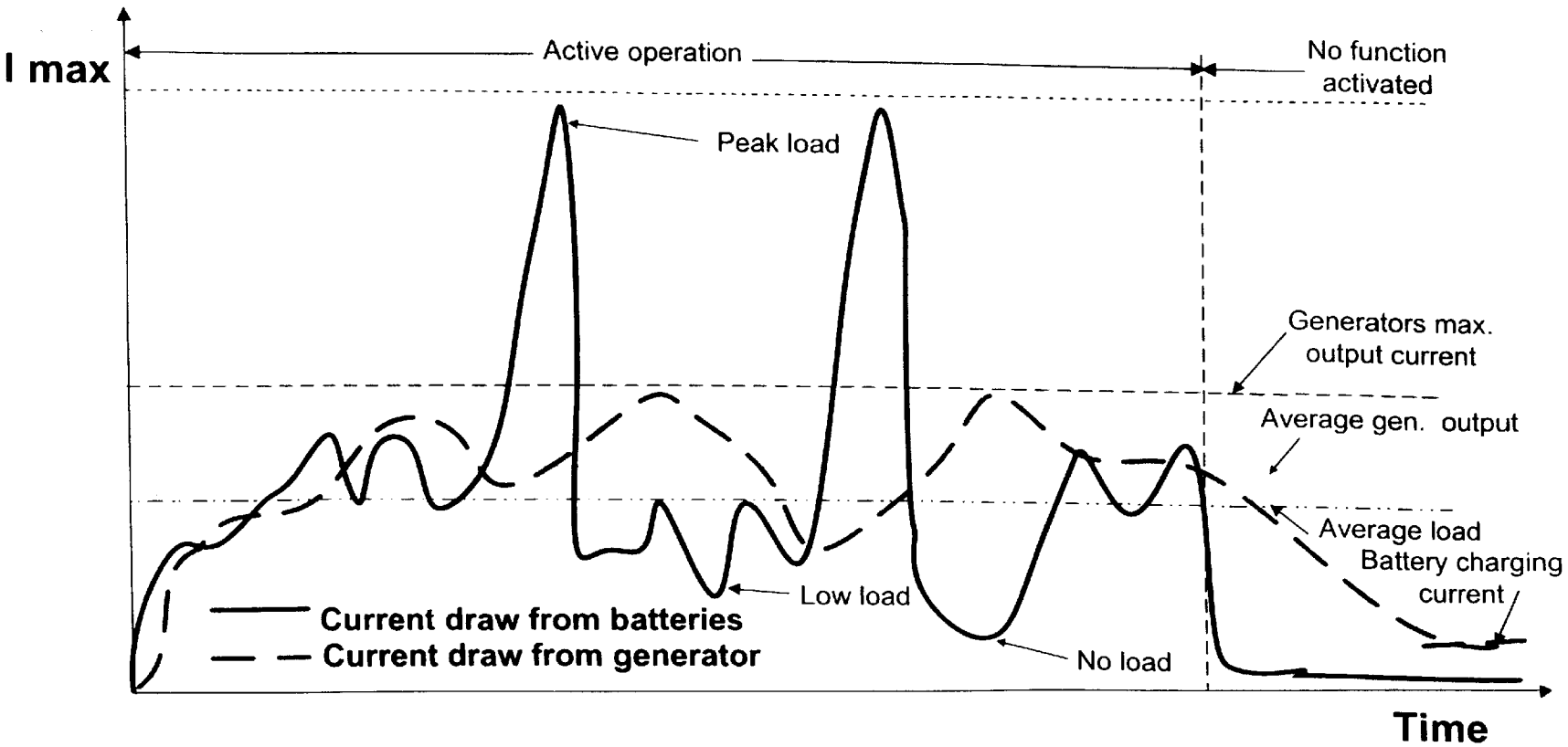
FIG. 6 is a graphical diagram of battery and generator current when the preferred embodiment of the hybrid power system of the present invention is operated in hybrid mode.

As depicted in FIG. 6, when the apparatus requires peak power, the generator 204 supplies the battery pack 208 with less power than is being removed from the batteries. The generator assembly 202 is unable to supply peak power to the apparatus because the engine 206 is sized to provide slightly more than the average power requirements of the apparatus.

Conversely, when the apparatus requires low or zero power, the generator 204 supplies the battery pack 208 with more power than is being depleted from the batteries. Due to this averaging of power output from the generator assembly 202, the use of a smaller IC engine 206, which is more fuel efficient, less noisy and environmentally friendlier than conventionally sized engines, is permitted.

As can be appreciated from the above passage, when the apparatus is operated in hybrid mode, the generator 204 may operate as either or both of a battery charge maintainer and a battery charger, depending on apparatus use requirements. The generator 204 operates as a battery charge maintainer (i.e., in the "maintenance mode") when it provides sufficient power to the battery pack 208 to satisfy existing power demands, but the battery pack 208 is not charged to 100% charge. The maintenance mode prevents overcharging and damaging the batteries when the apparatus is in operation.

Figure 7:
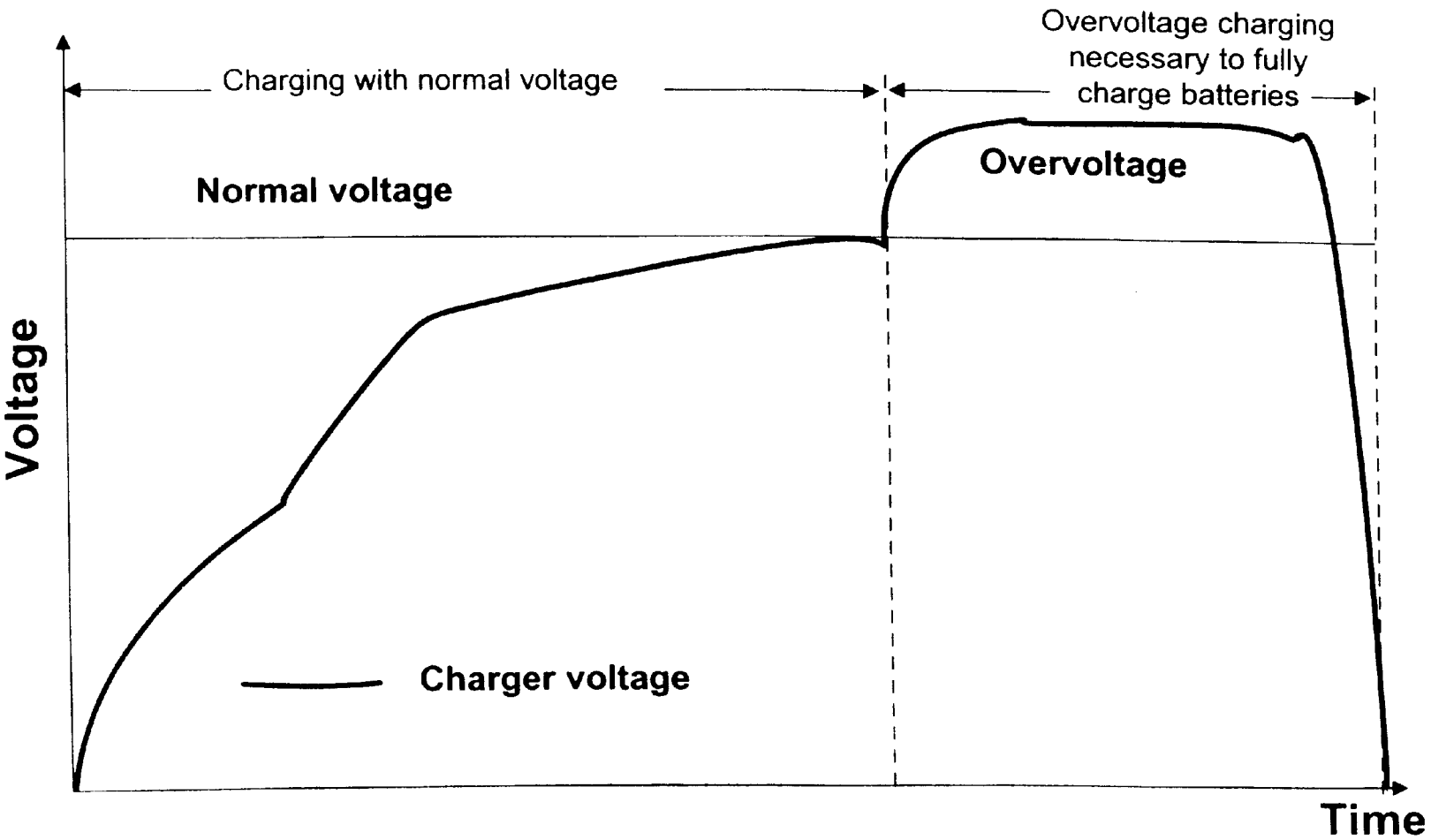
FIG. 7 is a graphical diagram of conventional charger logic for charging batteries.

The sensor circuit 207, which is preferably disposed between the generator 204 and the battery pack 208, continually measures the condition of charge of the battery pack 208. The condition of charge may be measured by any suitable method, including measuring the change in voltage, the specific gravity of the battery fluid or the amperage draw over time. When the sensor circuit 207 detects that the apparatus is not being operated, the generator 204 switches to the charging mode to charge the battery pack 208. According to conventional charger logic, as graphically depicted in FIG. 7, the generator 204 will adjust its output voltage to charge the battery pack 208 when the apparatus is not being operated.

Figure 8:
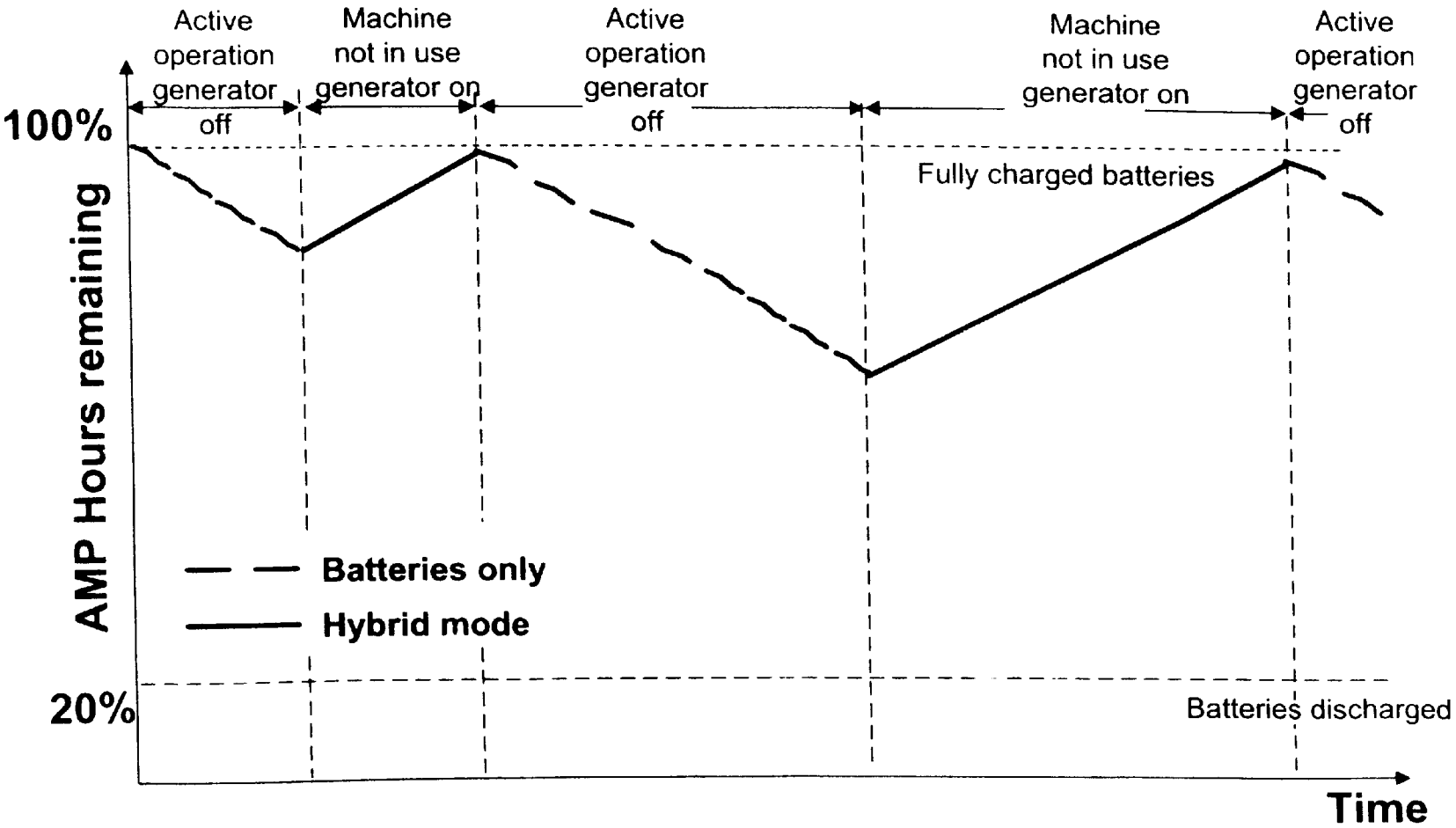
FIG. 8 is a graphical diagram of the battery duty cycle of the preferred embodiment of the hybrid power system shown in FIG. 5.

The battery duty cycle of an apparatus incorporating the hybrid power system 200 is depicted graphically in FIG. 8. While the apparatus is being operated in battery mode, the power of the battery pack 208 is gradually depleted as previously described. However, when the apparatus is not being used, it may simply be taken to a place where the generator assembly 202 may be operated to recharge the battery pack 208. As a result, the apparatus may be operated indefinitely, requiring only an occasional refueling, which may be accomplished in a few minutes. Of course, as mentioned above, an external AC power source may also be used to recharge the battery pack 208, if desired.

However, it may not always be possible to operate the generator 204 sufficiently long between apparatus uses to fully charge the battery pack 208. Because, as explained above and discussed below, the average generator 204 output to the battery pack 208 exceeds the average power usage of the apparatus, apparatus performance is not degraded by the lack of fully-charged batteries.

Figure 9:
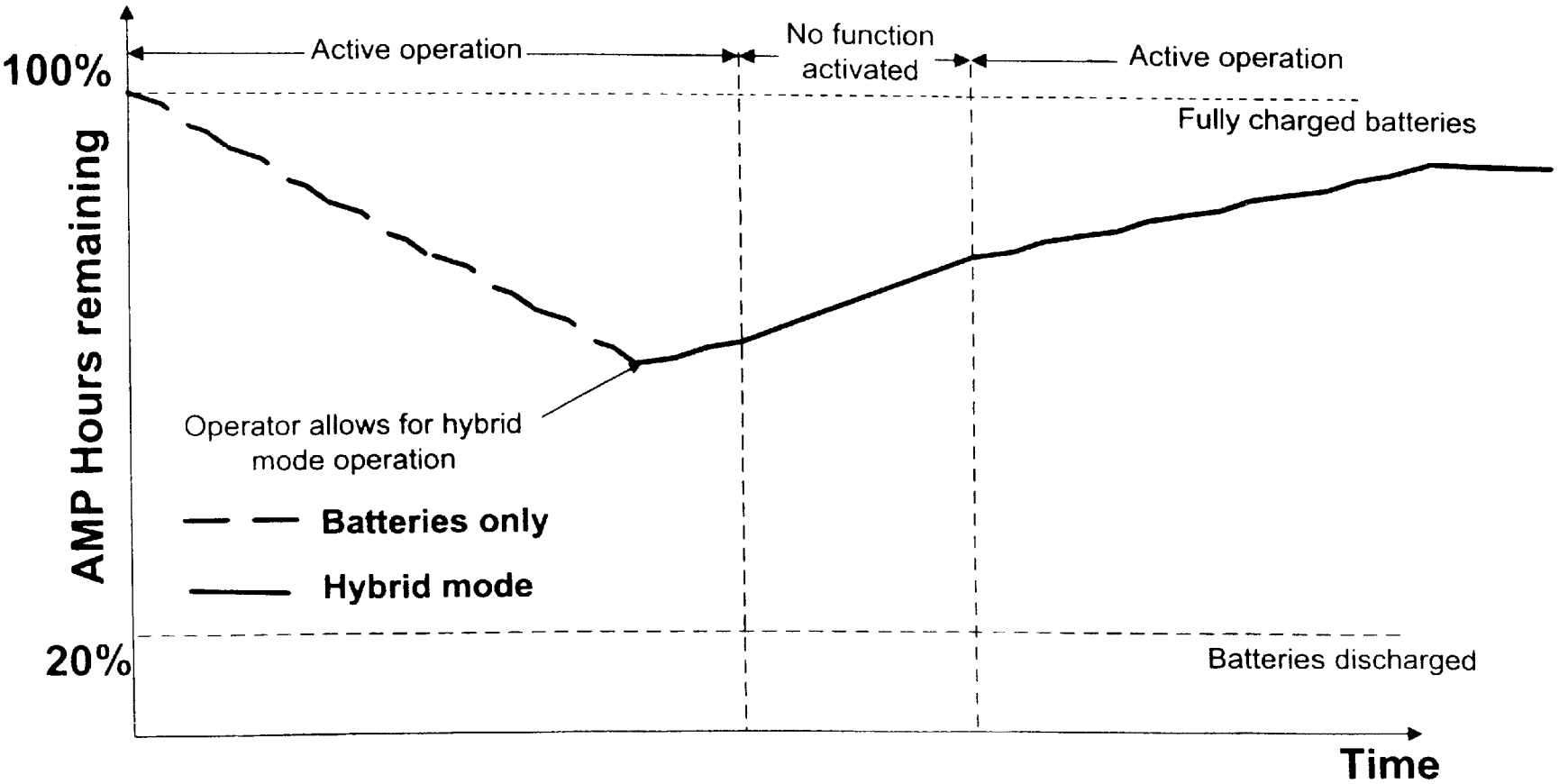
FIG. 9 is a graphical diagram of battery current when the preferred embodiment of the hybrid power system is operated in battery mode and hybrid mode.

FIG. 9 graphically depicts an apparatus in typical "indoor/outdoor" use. Indoors, the apparatus is operated in battery mode and uses battery power in the same manner as conventional battery-powered apparatuses (see FIG. 4). However, when the apparatus is taken outdoors, perhaps to be driven to the next building or construction zone, the engine 206 may be started to operate the apparatus in hybrid mode. In hybrid mode, the generator 204 not only supplies sufficient power to the battery pack 208 to compensate for the power consumption of the apparatus, but also supplies additional power to the battery pack 208 to restore its charge. As can be appreciated, the rate at which the charge of the battery pack 208 increases is dependent upon the apparatus functions being used.

Figure 10:
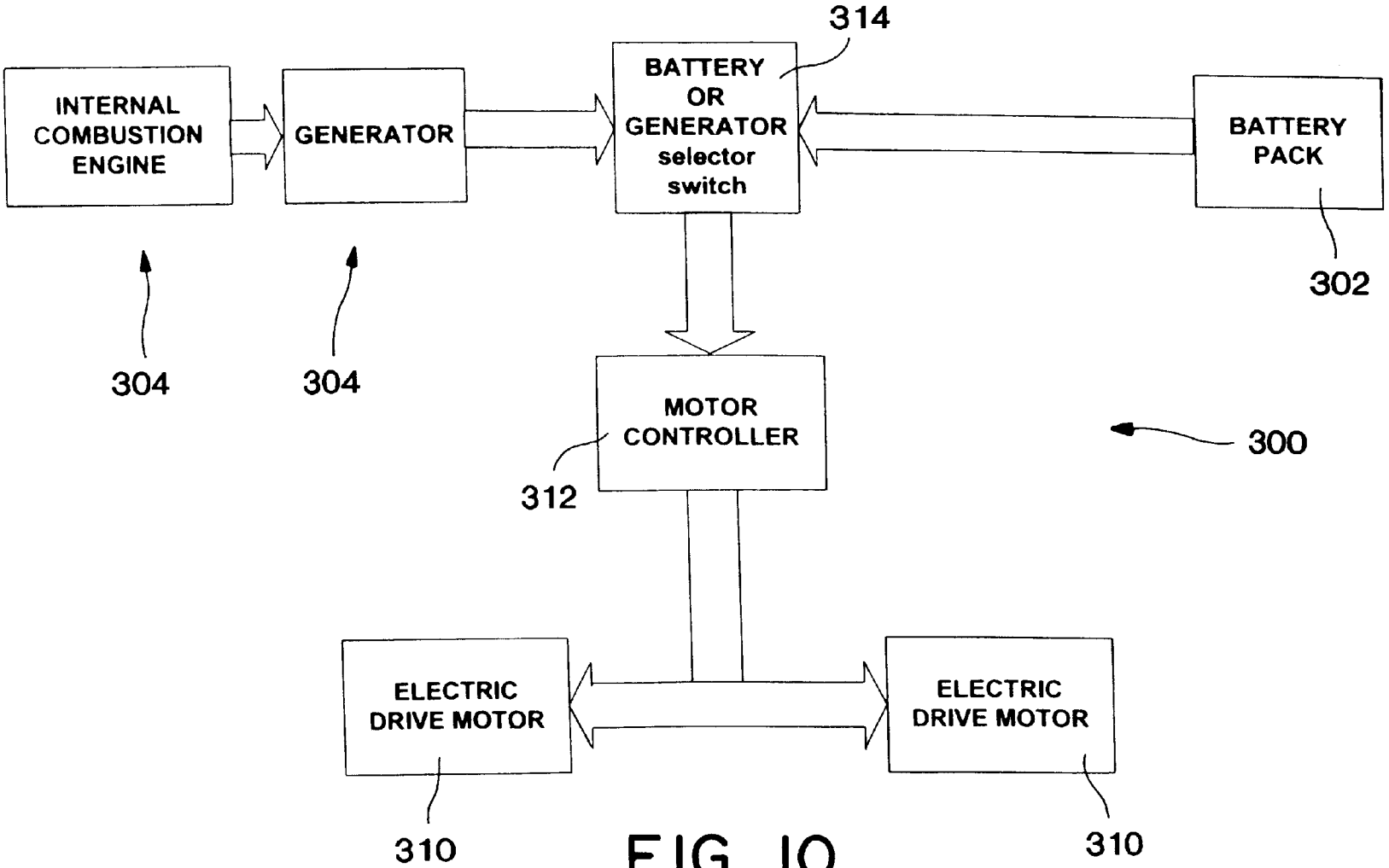
FIG. 10 is a block schematic diagram of an alternate embodiment of the hybrid power system of the present invention.

In an alternate embodiment of the present invention, three power sources may be used to power an apparatus. As shown in FIG. 10, the alternate embodiment of the hybrid power system 300 includes a battery pack 302, an IC engine-powered generator assembly 304, and a selector switch 314 operably connected to the battery pack 302 and the generator assembly 304. The remaining drive components of the apparatus may be the same as those discussed above with respect to the preferred embodiment 200.

As shown in FIG. 10, the switch 314 may be used to select whether the apparatus is operated on battery power alone (i.e., battery mode), on engine power alone (i.e., engine mode) or on a combination of battery and engine power (i.e., hybrid mode). Except for requiring a larger engine to meet the peak power requirements of the apparatus when it is operated in engine mode, the alternate embodiment would function substantially the same in most other respects as the preferred embodiment.

The following components may be used in the present invention: the IC engine 206 may be an 8 to 10 horsepower gasoline, liquid propane or diesel engine supplied by Briggs and Stratton or Yanmar; the generator 204 may be a 4.5 to 6.0 kW 48 Volt DC generator supplied by Onan or Libby; the battery pack 208 may comprise eight 6 Volt DC batteries supplied by Douglas or Trojan; the motor controller 212 may be a 600 amp MOS FET controller supplied by Sevcon; and the electric drive motors 210 may be 6⅞ inch series wound motors supplied by Advanced DC Motors.

The present invention provides an apparatus that can be operated either on battery power alone (i.e., battery mode) or on a combination of battery and engine power (i.e., hybrid mode). Depending on need (i.e., battery assist or recharge) or operation constraints (i.e., "indoor" versus "outdoor" use), the apparatus may be switched, on demand, between battery mode and hybrid mode.

Because the apparatus may be operated in practically any construction or maintenance environment, rental fleet operators, construction companies and the like will be able to make do with a smaller inventory of vehicles and equipment.

It should be appreciated that the present invention may be modified or configured as appropriate for the application. The embodiments described above are to be considered in all respects only as illustrative of the present invention, and not i restrictive. The scope of the invention is indicated by the following claims rather than by the foregoing description. All changes which come within the meaning and range of equivalency of the claims are to be embraced within their scope.

What is claimed is:

1. A mobile access vehicle comprising:

a base;

lifting apparatus, connected to said base, adapted for controllably transporting a load in a selected direction having a vertical component;

at least one generator assembly comprising a power source operable to power a generator;

at least one battery assembly comprising at least one battery, the generator operably associated in series with the at least one battery assembly;

at least one drive system operably associated with the at least one battery assembly, the at least one drive system comprising a propulsion assembly for propelling the vehicle and a positioning assembly for driving said lifting apparatus; and a selector operably associated with the at least one generator assembly, the selector operable to select either of the following (A) or (B) to power the at least one drive system of the vehicle:

(A) the at least one battery assembly; or (B) both of the at least one generator assembly and the at least one battery assembly; whereby, with the selection of (B), the generator charges the at least one battery assembly;

wherein, upon both of the at least one generator assembly and the at least one battery assembly being selected to power the at least one drive system of the vehicle, the generator is operable to substantially maintain the charge of the at least one battery assembly and is also operable to substantially increase the charge of the at least one battery assembly;

said vehicle further comprising a sensor circuit operably associated with at least the at least one battery assembly, the sensor circuit operable to detect the condition of charge of the at least one battery assembly;

said vehicle further comprising at least one switch being automatically operable, responsive to said sensor circuit, to switch the generator between a battery charging mode and a battery charge maintenance mode depending on whether the vehicle is being operated, wherein the generator is switched to the battery charging mode when the vehicle is not being operated.

2. The vehicle of claim 1 wherein the at least one battery assembly is selected to power the at least one drive system of the vehicle.

3. The vehicle of claim 2 wherein the at least one battery assembly powers the at least one drive system of the vehicle until the at least one battery is depleted.

4. The vehicle of claim 2 wherein the at least one generator assembly is activated to charge the at least one battery of the at least one battery assembly.

5. The vehicle of claim 2 wherein an external power source is utilized to charge the at least one battery of the at least one battery assembly.

6. The vehicle of claim 1 wherein the generator substantially maintains the charge of the at least one battery assembly when the vehicle is being operated and the average power consumption of the at least one drive system of the vehicle is substantially equal to the average power output of the at least one generator assembly.

7. The vehicle of claim 1 wherein the generator increases the charge of the at least one battery assembly when the vehicle is not being operated.

8. The vehicle of claim 1 wherein the generator increases the charge of the at least one battery assembly when the vehicle is being operated and the average power consumption of the at least one drive system of the vehicle is less than the average power output of the at least one generator assembly.

9. The vehicle of claim 1 wherein the at least one switch is operable to switch the generator to the battery charge maintenance mode when the vehicle is being operated and the power output of the at least one generator assembly is substantially equal to or greater than the average power consumption of the at least one drive system.

10. The vehicle of claim 1 wherein the propulsion assembly comprises an electric drive motor assembly.

11. The vehicle of claim 1 wherein the propulsion assembly comprises:

at least one drive motor operably associated with at least one propulsion device for the apparatus; and a motor controller operably associated with the at least one drive motor, the motor controller operable to control the speed of the at least one drive motor.

12. The vehicle of claim 11 wherein the at least one propulsion device comprises one or more wheels.

13. The vehicle of claim 1 wherein the positioning assembly comprises:

at least one electric motor; and at least one actuator operably associated with the at least one electric motor, the actuator operable to power said lifting apparatus.

14. The vehicle of claim 13 wherein the lifting apparatus comprises one or more of a boom lift, a scissors lift and a vertical lift.

15. The vehicle of claim 1 wherein the power source is sized to meet the average power demands of the at least one drive system.

16. The vehicle of claim 1 wherein the at least one battery assembly or both of the at least one generator assembly and the at least one battery assembly provide the apparatus with substantially the same performance capabilities.

17. The vehicle according to claim 1, wherein said generator and said at least one drive system are operably associated with one another through the intermediary of said at least one battery assembly.

* * * * *